United States Patent [19]

Kroes et al.

[11] Patent Number: 4,927,217

[45] Date of Patent: May 22, 1990

[54] ELECTRODELESS LOW-PRESSURE DISCHARGE LAMP

[75] Inventors: Anthony Kroes; Pieter G. Van Engen, both of Eindhoven, Netherlands

[73] Assignee: U.S. Philips Corp., New York, N.Y.

[21] Appl. No.: 204,146

[22] Filed: Jun. 8, 1988

[30] Foreign Application Priority Data

Jun. 26, 1987 [NL] Netherlands ..... 8701496

[51] Int. Cl.[5] ..... H05B 41/16

[52] U.S. Cl. ..... 315/248; 315/57; 313/493

[58] Field of Search ..... 315/248, 344.57, 85, 315/75; 313/493; 336/175, 176, 177, 173, 174

[56] References Cited

U.S. PATENT DOCUMENTS

| | | | |
|---|---|---|---|
| 3,521,120 | 7/1970 | Anderson | 315/57 |
| 4,119,889 | 10/1978 | Hollister | 315/248 |
| 4,247,800 | 1/1981 | Proud et al. | 315/248 |
| 4,266,167 | 5/1981 | Proud et al. | 315/248 |
| 4,298,828 | 11/1981 | Justice et al. | 315/248 |
| 4,422,017 | 12/1983 | Denneman et al. | 315/248 |
| 4,455,508 | 6/1984 | Wesselink | 313/493 |
| 4,727,295 | 2/1988 | Postma et al. | 315/248 |
| 4,728,867 | 3/1988 | Postma et al. | 315/248 |

*Primary Examiner*—Leo H. Boudreau
*Assistant Examiner*—Michael Razavi
*Attorney, Agent, or Firm*—Emmanuel J. Lobato

[57] ABSTRACT

The electrodeless low-pressure discharge lamp has a lamp vessel (1) with a protuberance (2), in which an electrical coil (4) is situated around a soft magnetic body (3). A heat-resistant envelope (5) separates the coil (4) from the body (3).

10 Claims, 1 Drawing Sheet

ELECTRODELESS LOW-PRESSURE DISCHARGE LAMP

BACKGROUND OF THE INVENTION

The invention relates to an electrodeless low-pressure discharge lamp comprising a discharge vessel sealed in a vacuum-tight manner and having a discharge space containing an ionizable vapor and a rare gas, the discharge vessel having a protuberance protruding into the discharge space, and a body of soft magnetic material, which is surrounded by an electrical coil, the magnetic body and coil being provided in the probuberance.

Such an electrodeless low-pressure mercury discharge lamp is known from GB No. 2,133,612A.

Such electrodeless lamps are favorable because their discharge vessel has small dimensions as compared with commercially available low-pressure discharge lamps provided with electrodes. The light generated by the lamps can thus be more readily concentrated by means of a luminaire. Furthermore, disadvantageous effects of electrodes on the life do not occur in the lamps.

A disadvantage is that the body of soft magnetic material is surrounded for the major part by the discharge, as a result of which the temperature of said magnetic body becomes comparatively high. Soft magnetic materials, such as ferrites, are in fact sensitive to heat. Their specific magnetic losses increase with increasing temperature, while at elevated temperature the magnetic permeability starts to decrease. Due to these factors the efficiency of the lamp is low.

SUMMARY OF THE INVENTION

The invention has for its object to provide a lamp having a construction by which the decrease in efficiency of the lamp is counteracted.

In a lamp of the kind described in the opening paragraph, this object is achieved in that the body of soft magnetic material has a heat-resistant envelop of an electrical insulator, which separates the electrical coil from said body.

Due to this heat resistant envelope, the soft magnetic body is kept at a lower temperature during operation of the lamp. It has proved to be very advantageous that the heat-resistant envelope separates the electrical coil from the soft magnetic body. The distance of the electrical coil from the discharge space is consequently smaller than if the coil is arranged to surround directly the soft magnetic body and is also surrounded by the envelope. This results in a reduction of the voltage at which a magnetically induced discharge is obtained.

The heat-resistant envelope may be made, for example, of flourinated hydrocarbon polymer or of aerogel, for example on the basis $SiO_2$ or $Al_2O_3$, as the case may be modified with, for example, $Fe_3O_4$.

With the use of a soft material as an aerogel, the electrical coil is carried in a favourable embodiment by a tubular electrically insulating body of, for example, glass or ceramic material. A translucent or non-translucent light-reflecting layer may be provided between the heat-resistant envelope and the discharge space, for example on a tubular body carrying the electrical coil. Alternatively or in addition, the protuberance into the discharge vessel may have such a layer of, for example, $Al_2O_3$. Such a layer throws inwardly directed radiation outwards.

Some low-discharge lamps, such as low-pressure sodium discharge lamps, are optimum at a lowest temperature of the discharge vessel of approximately 260° C. This is in contrast with low-pressure mercury discharges, which are optimum at a lower temperature in the discharge of approximately 40°–90° C.

In order to attain the said lowest temperature, commercially available low-pressure sodium lamps having electrodes are provided with an outer bulb.

The outer bulb is mostly evacuated and provided with an IR-reflecting coating.

The construction of the lamp according to the invention permits of surrounding the discharge vessel, the body of soft magnetic material and the electrical coil by an outer bulb and evacuating the latter. With a discharge in an ionizable vapor, for which a comparatively high lowest temperature is favorable, such as, for example, sodium, aluminum chloride, tin chloride, an increased efficiency can then be obtained. It is then favorable that IR radiation is thrown back onto the discharge by an IR reflecting coating on the outer bulb, for example of tin-doped indium oxide. This IR reflecting coating can be connected to earth or via a capacitor to the zero conductor to the electrical coil in order to suppress the occurrence of an electric field around the lamp, which disturbs radio reception.

BRIEF DESCRIPTION OF THE DRAWINGS

Embodiments of the lamp according to the invention are shown in the drawings. In the drawings.

DETAILED DESCRIPTION OF THE INVENTION

Figure 1:
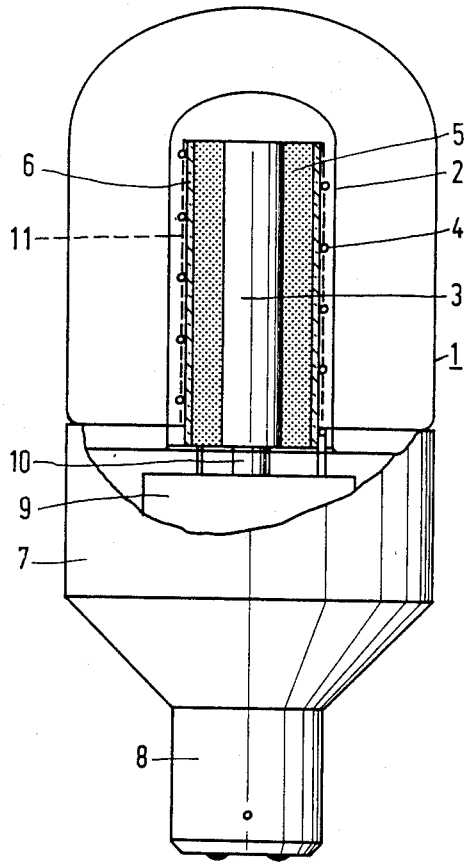
FIG. 1 shows a side elevation partly broken away of a first embodiment.

In FIG. 1, the lamp has a glass discharge vessel 1, which is sealed in a vacuum-tight manner and encloses a discharge space containing an ionizable vapor and a rare gas. The discharge vessel 1 has a protuberance 2, in which a body 3 of soft magnetic material surrounded by an electrical coil 4 is arranged together with said coil 4.

The body 3 of soft magnetic material, for example 4C6 ferrite, has a heat-resistant envelope 5, for example of $Al_2O_3/Fe_3O_4$ (90/10 weight) aerogel, which keeps the electrical coil 4 separated from the body 3. Because of the small mechanical strength of the envelope 5, the coil 4 is supported by a glass tube 6.

The discharge vessel 1 is fixed in a bowl 7 of synthetic material carrying a lamp cap 8. In the bowl 7 is mounted a supply apparatus 9 having an output frequency of at least 1 MHz, to which supply apparatus is connected on the one hand the electrical coil 4 and on the other hand the lamp cap 8, while the body 3 is fixed on this apparatus via a support 10 of, for example, synthetic material.

Figure 2:
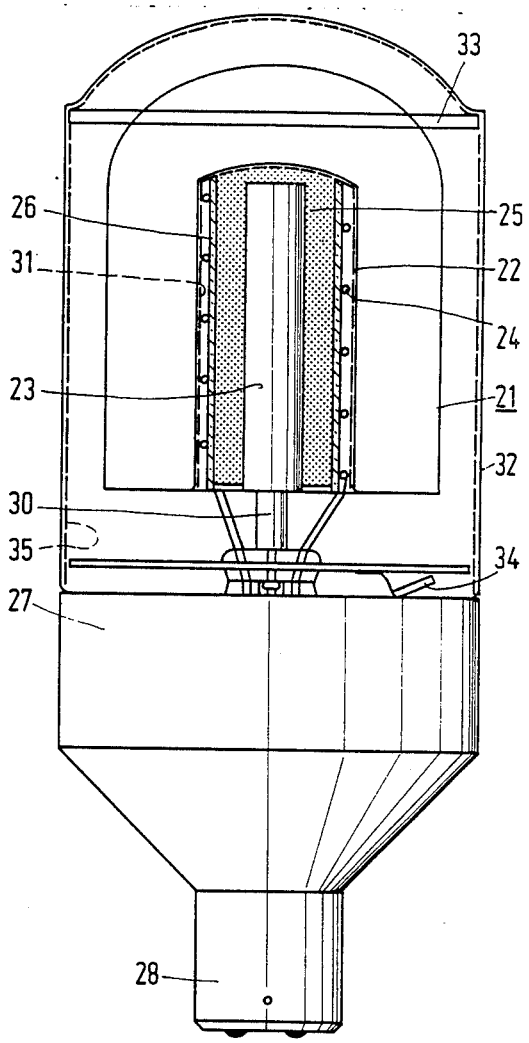
FIG. 2 shows a side elevation partly broken away of a second embodiment.

In FIG. 2, parts corresponding to parts of FIG. 1 have a preference numeral which is 20 higher.

The discharge vessel 21, the body 23 of soft magnetic material and the electrical coil 24 are surrounded by an evacuated outer bulb 32, which is coated with a layer 35 reflecting IR radiation, for example of tin-doped indium oxide. A transparent annular disk 33 holds the discharge vessel 21 in position. A getter for residual gases can be evaporated from a container 34. A light-scattering layer 31 is provided on the protuberance 22. A reflecting metal plate throws incident radiation back in directions remote from the lamp cap 28.

The discharge vessel is filled with sodium vapour and with approximately 100 Pa argon at room temperature.

Lamps filled with sodium vapor and having the configuration shown in FIG. 2 (*a*) were compared with similar lamps, not according to the invention in which the coil 24 is situated within the heat-resistant envelope 25 directly around the body of soft magnetic 23 (*b*), and with lamps not according to the invention, in which NO heat-resistant envelope 25 is present and the coil 24 is arranged to surround directly the body 23 of soft magnetic material. The lamps were operated at an alternating voltage of 2.65 Mz. Their ignition voltage and efficiency in lumens per watt were measured. The results are stated in Table 1.

TABLE 1

| Lamps | 023 (mm) | 024 (mm) | $V_{ign}$ ($V_{eff}$) | (1m/W) |
|---|---|---|---|---|
| a | 9 | 12 | 370 | 144 |
| b | 9 | 9 | 440 | 144 |
| c | 9 | 9 | 440 | 132 |

It appears from this table that the efficiency of the lamp according to the invention (a) is higher than that of lamps without a heat-resistant envelope (c) and further that its ignition voltage is lower than that of lamps (c) and of lamps in which the coil is situated within the heat-resistant envelope (b).

In Table 1 $V_{eff}$, means the effective voltage, that is the peak value of the voltage divided by V2.

What is claimed is:

1. An electrodeless low-pressure discharge lamp comprising a discharge vessel sealed in a vacuum-tight manner and having a discharge space containing an ionizable vapour and a rare gas.

the discharge vessel having a protuberance protruding into the discharge space, a body of soft magnetic material surrounded by an electrical coil, this body and this coil being provided in said protuberance in the discharge vessel, characterized in that the body of soft magnetic material has a heat-resistant envelope of an electrical and thermal insulator, which separates the electrical coil from said body.

2. An electrodeless discharge lamp as claimed in claim 1, characterized in that a reflecting layer is provided between the heat-resistant envelope and the discharge space.

3. An electrodeless discharge lamp as claimed in claim 1 characterized in that the discharge vessel with the body of soft magnetic material, the coil and the heat-resistant envelope is surrounded by an outer bulb which is evacuated.

4. An electrodeless discharge lamp as claimed in claim 2, characterized in that the discharge vessel with the body of soft magnetic material, the coil and the heat-resistant envelope is surrounded by an outer bulb which is evacuated.

5. In an electrodeless low-pressure discharge lamp comprising a discharge vessel having an inwardly extending hollow elongate protrusion, a magnetic core of soft magnetic material within the hollow protrusion, and a conductive coil wound around the magnetic core, the improvement comprising: thermal insulating means for thermally insulating said magnetic core during lamp operation and preventing degradation of the magnetic properties of said magnetic core from overheating.

6. In an electrodeless low-pressure discharge lamp according to claim 5, wherein said hollow protrusion is elongated and has a major length dimension extending inwardly of said discharge vessel;

said magnetic core is elongated and is positioned within said elongated hollow protrusion axially thereof;

said conductive coil is wound along the length dimension of said magnetic core and said elongated hollow protrusion, and said conductive coil is wound substantially the maximum diameter that said elongate hollow protrusion will accommodate; and said thermal insulating means is comprised of an electrically and thermally insulative material filling the space between said conductive coil and said magnetic core and effectively insulating said magnetic core during lamp operation to avoid thermal degradation of the magnetic properties of said magnetic core.

7. In an electrodeless low-pressure discharge lamp according to claim 6, wherein said thermal insulating means is effective to insulate said magnetic core for discharge vessel temperatures in the range of approximately 40° to 90° C.

8. In an electrodeless low-pressure discharge lamp according to claim 6, wherein said thermal insulating means is effective to insulate said magnetic core for discharge vessel temperatures in the range of approximately 260° C.

9. In an electrodeless low-pressure discharge lamp according to claim 5, wherein said thermal insulating means is effective to insulate said magnetic core for discharge vessel termperatures in the range of approximately 40° to 90° C.

10. In an electrodeless low-pressure discharge lamp according to claim 5, wherein said thermal insulating means is effective to insulate said magnetic core for discharge vessel temperatures in the range of approximately 260° C.

* * * * *